US005179766A

United States Patent [19]

Matusek

[11] Patent Number: 5,179,766

[45] Date of Patent: Jan. 19, 1993

[54] BELT BUCKLE

[76] Inventor: Ronald C. Matusek, 12908 N. 72nd Ave., Peoria, Ariz. 85381

[21] Appl. No.: 815,418

[22] Filed: Dec. 31, 1991

[51] Int. Cl.[5] ..... A44B 11/00

[52] U.S. Cl. ..... 24/163 K; 24/186

[58] Field of Search ..... 24/163 K, 163 R, 169, 24/186, 265 WS, 113 MP, 67.9, 90 A

[56] References Cited

U.S. PATENT DOCUMENTS

| | | | |
|---|---|---|---|
| 309,045 | 12/1884 | Halsey | 24/90 A |
| 374,177 | 12/1887 | Detrick | 24/186 |
| 411,777 | 10/1889 | Behrens | 24/169 |
| 3,633,249 | 1/1972 | Nesheim | 24/169 |
| 3,908,239 | 9/1975 | Gorman | 24/163 K |
| 3,913,147 | 10/1975 | Ostrander | 24/186 |
| 3,927,442 | 12/1975 | Foster | 24/163 K |
| 4,052,773 | 10/1977 | Nesbitt | 24/163 K |
| 4,170,808 | 10/1979 | Knowles | 24/163 K |
| 4,377,939 | 3/1983 | Reinsdorf | 24/163 K |
| 4,961,250 | 10/1990 | Calavenna | 24/265 WS |

FOREIGN PATENT DOCUMENTS

| | | | |
|---|---|---|---|
| 0198278 | 10/1986 | European Pat. Off. | 24/163 K |

*Primary Examiner*—Victor N. Sakran

*Attorney, Agent, or Firm*—Cahill, Sutton & Thomas

[57] ABSTRACT

A belt buckle having a decorative face is described and is formed of a molded plastic material in which the decorative face is integral with the remainder of the buckle body. A rigid frame member is encased within the plastic material and includes a loop formed at one end thereof extending from the inside face of the belt buckle to receive one end of a belt. The frame member includes a hook in an opposite end thereof connected to the loop by an intermediate portion; the hook extends outwardly from the rear face of the buckle to permit the hook to be inserted into holes provided therefor in the belt.

6 Claims, 2 Drawing Sheets

BELT BUCKLE

FIELD OF THE INVENTION

The present invention relates to belt buckles, and more particularly buckles of the type incorporating a loop for attachment to a belt and a hook for insertion into holes provided at an opposite end of a belt. More particularly, the invention relates to belt buckles of the type having a provision for the incorporation of a decorative facing.

BACKGROUND OF THE INVENTION

Belt buckles, particularly the type sometimes referred to as a western buckle, usually incorporate a decorative facing immediately visible to observers. Such facings include fanciful designs, initials, logos, and sometimes three-dimensional pictorial representations. The use of such belt buckles for advertising purposes has become popular, and it is not uncommon to see belt buckles having familiar logos representing various manufacturers such as truck and automobile manufacturers, beer brands, or other such highly visible and publicized product logos.

The utilization of customized facings on belt buckles usually requires expensive manufacturing processes which therefore increase the cost of such buckles. It is therefore highly unusual for such buckles incorporating complex logos to be seen as promotional items that can be dispensed at a nominal price or perhaps even given away. Indeed, logos of popular brands of merchandise are frequently made available at a relatively high purchase price and may even become a second profitable market in and of themselves.

For those organizations that would like to avail themselves of the advertising benefits of customized belt buckles it is nearly impossible to command a sufficient price for the belt buckles to make it economically feasible to attempt to advertise in this manner.

It is therefore an object of the present invention to provide a belt buckle construction that permits the incorporation of a decorative face at low cost.

It is another object of the present invention to provide a belt buckle construction that may be produced at very low cost while nevertheless permitting customized pictorial facings such as logos and the like.

It is still another object of the present invention to provide a belt buckle having a decorative face that may be produced very inexpensively and without the need for complex and expensive machinery to thereby make small batch processing of such belt buckles economically feasible.

SUMMARY OF THE INVENTION

Briefly, in accordance with the embodiment chosen for illustration, a belt buckle is formed of a suitably cast moldable plastic material having a front face that includes a desired decorative pattern such as a name, initials, logos and the like. The molded plastic material has imbedded therein a metal frame member having a loop formed on one end thereof and a hook on the opposite end thereof. The hook and loop are joined by a metal intermediate portion that rigidly and permanently connects the loop and the hook. The metal frame may conveniently and inexpensively be formed of wire that has been bent into an appropriate shape. The loop is conformed to accept the end of a belt which is typically folded over the loop and snapped or otherwise fastened to connect the end of the belt to the belt buckle. The hook protrudes from the inner face of the molded plastic and provides a means for fastening the opposite end of the belt to the buckle through the insertion of the hook in holes provided in the belt. The mold in which the belt buckle is formed may itself comprise molded plastic material taken directly from any desired three-dimensional object that is intended to be displayed on the facing of the buckle. The resulting belt buckle is therefore a molded plastic body having a molded decorative face integral therewith and having imbedded therein a metal frame member having a hook protruding from the inner face of the buckle toward one end of the buckle and a loop protruding from the inner face of the buckle at the opposite end.

BRIEF DESCRIPTION OF THE DRAWINGS

The present invention may more readily be described by reference to the accompanying drawings in which.

DETAILED DESCRIPTION OF THE DRAWINGS

Figure 2:
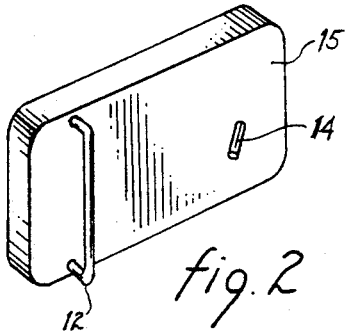
FIG. 2 is a perspective view of the rear of the belt buckle of FIG. 1.
Figure 1:
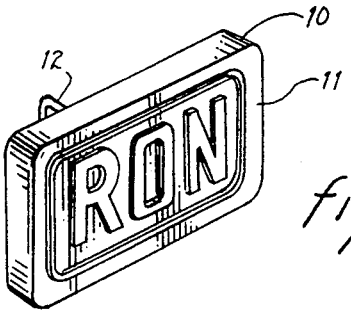
FIG. 1 is a perspective view of a belt buckle constructed in accordance with the teachings of the present invention showing the decorative face of the buckle.

Referring now to FIGS. 1 and 2, a belt buckle constructed in accordance with the teachings of the present invention is shown wherein it may be seen that a belt buckle body 10 incorporates a decorative face 11 which may contain a chosen three-dimensional decorative configuration such as initials, a logo, or as shown, a name. The belt buckle body in the embodiment chosen for illustration is constructed of polyurethane and incorporates within it a rigid frame member having a loop 12 and a hook 14, each of which extends from the rear face 15 of the buckle body. The loop 12 is appropriately dimensioned to receive the end of a belt (not shown) that can be threaded through the loop and folded over onto itself; belts usually incorporate some type of fastening means such as rivets, screws or snaps so that the folded portion passing through the loop is secured to the belt buckle at the loop. The hook 14 is dimensioned to permit the hook to be inserted in holes provided at the opposite end of a belt in a manner well known in the art.

Figure 3:
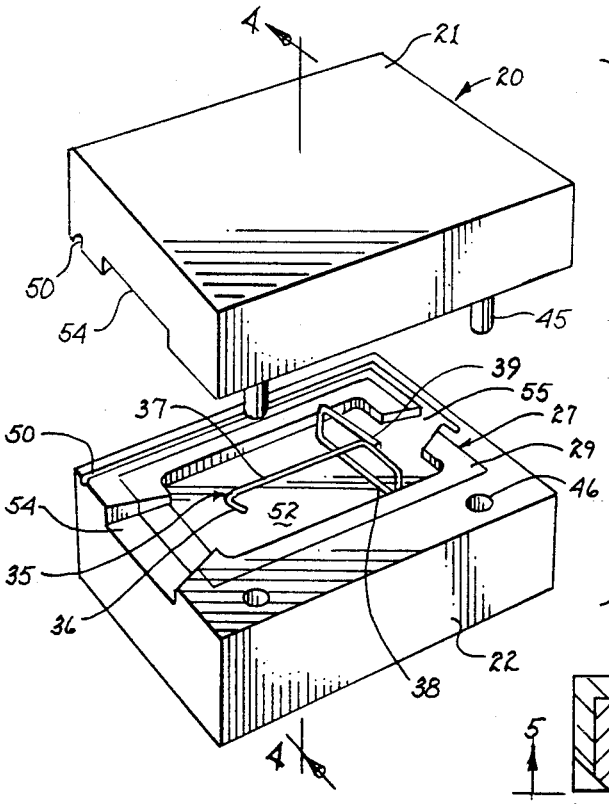
FIG. 3 is an exploded view of a suitable mold mechanism for manufacturing the buckle of the present invention.
Figure 4:
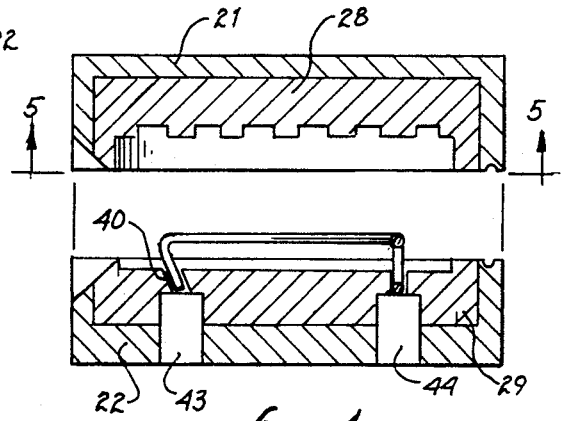
FIG. 4 is a cross-sectional view of FIG. 3 taken along line 4—4.

The belt buckle of FIGS. 1 and 2 may be produced in a variety of fashions including the utilization of an injection mold such as shown at FIG. 3. Referring now to FIGS. 3 and 4, a mold housing 20 including a housing top 21 and a mold housing bottom 22 are shown within which is positioned a "soft" or plastic mold 27 divided into an upper portion 28 and lower portion 29. The upper portion 28 of the mold may include a negative 30 of the desired three-dimensional design that is intended to be utilized on the decorative face of the belt buckle. A rigid frame member 35, that in the embodiment shown in FIGS. 3 and 4 is formed of a wire bent into an appropriate configuration, is supported within the mold. The rigid frame member 35, if formed of wire, can conveniently be bent utilizing conventional wire bending machines and it has been found that 120 gauge steel wire provides appropriate workability for utilization in such wire bending machines while also providing sufficient strength when in its final form to function as a rigid frame member for the belt buckle of the present invention. It may be noted that the rigid frame member 35 is formed of a single length of wire that has been bent or folded in respective directions, one end of which forms a hook 36 that is connected through an intermediate portion 37 to a loop 38. The end 39 of the wire that forms a part of the loop may, if desired, be tack welded to its adjacent portion of the wire, although such welding has been found not to be necessary in most instances.

The rigid frame member formed of wire as described is supported within the mold as shown in FIG. 4 with the loop and the hook ends facing downwardly and extending into receiving channels 40 and 41 within the bottom half of the mold. The frame member may be held in position through the utilization of magnets such as those shown at 43 and 44, although a variety of other techniques may be equally suitable. With the rigid frame member held in position, the upper and lower portions of the mold are placed in contact with each other with the alignment pins 45 inserted into the alignment holes 46 of the mold housing top and bottom respectively.

Fluid plastic material of the appropriate viscosity may then be fed into the injection passage 50 and into the cavity 52 surrounding the rigid frame member. The flowable plastic enters the mold and fills the mold cavity with the excess appearing at a well 54 opposite the input channel 55 of the injection passage.

When the cavity is full, the mold housing top and bottom are separated and the upper and lower mold portions are disengaged to permit the removal of the finished molded belt buckle. It may be noted that the mold itself may comprise solidified molded plastic material that has been formed in a "negative" three-dimensional design by copying from an existing buckle design. Alternatively, the solidified plastic material of the mold is easily cut or machined either through the use of manual shaping techniques or through more modern machining techniques to duplicate an appropriate logo or design in accordance with the manufacturer's desires.

Figure 5:
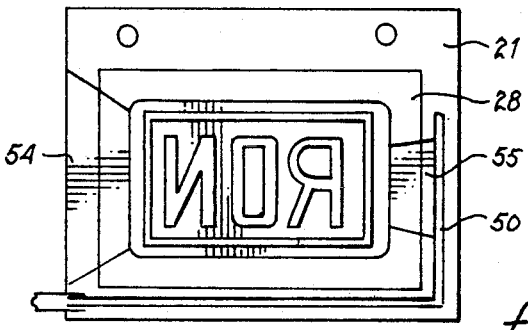
FIG. 5 is an elevational view of the mold housing top of the apparatus of FIG. 3 showing the "negative" of the chosen design.

The particular design chosen is of course readily changed and the "negative" half of the mold, which is more clearly illustrated in FIG. 5, may easily be changed. The rigid frame member such as shown in FIG. 3 is shown inverted in FIG. 6 wherein it may be seen that the wire chosen as the frame member may be formed of an appropriate gauge steel wire (e.g., 120 gauge) bent and formed using conventional wire forming machinery. Again, the contact 60 between the one end of the wire and the adjacent portion of the wire at the loop end of the member may be welded if desired. An alternative form of the rigid frame member is shown in FIG. 7 wherein it may be seen that the wire form has been replaced by a metal plate 61 that has been bent at an angle 62 and stamped to provide an opening 64 that enables the respective end of the sheet metal member to be utilized as a loop. A peg 65 or extension may be soldered or welded close to the opposite end of the plate to form the hook. Alternatively, the plate could be stamped or punched to cause a small segment of the sheet to bend inwardly as a substitute for the peg 65 shown in FIG. 7.

Figure 8:
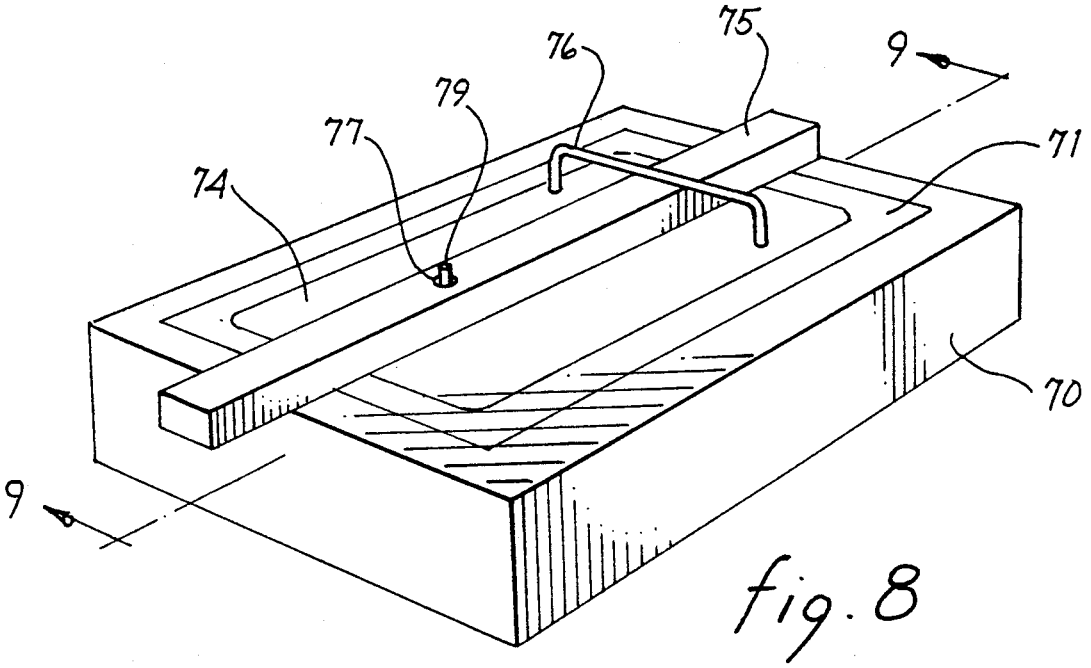
FIG. 8 is a perspective view of an alternate molding mechanism for the production of the belt buckle of the present invention.
Figure 9:
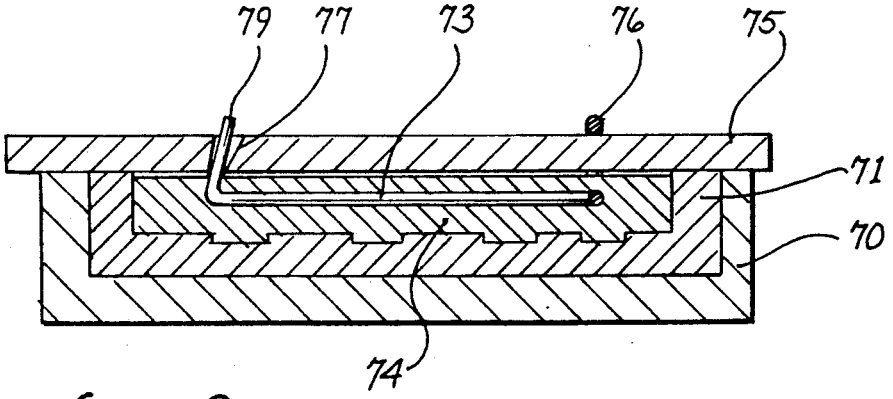
FIG. 9 is a cross-sectional view of FIG. 8 taken along line 9—9.

One of the chief advantages of the buckle of the present invention is the modest expense needed to create and manufacture customized or unique belt buckles having a particular three-dimensional outer face. As an example of the simplicity with which the belt buckle of the present invention can be made, reference may now be had to FIGS. 8 and 9. FIG. 8 is a perspective view of mold housing 70 within which a plastic mold 71 is formed. This plastic mold may be created by simply placing a suitable copy of the desired logo, emblem or design into the face of unhardened plastic material and permitting the material to harden. Polyurethane may be utilized for this purpose. With the mold thus completed, and a "negative" of the desired design obtained, a very simple duplication process to create the belt buckles of the present invention may be used.

Figure 6:
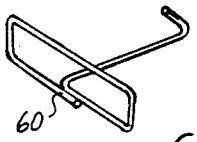
FIG. 6 is a perspective view of a rigid frame member formed of a wire bent into an appropriate confirmation.
Figure 7:
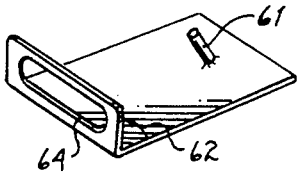
FIG. 7 is a perspective view of an alternate form of a rigid frame member formed from a metal plate.

A rigid frame member 73, such as the wire formed frame member of FIG. 6 is suspended in the volume 74 within which the plastic polyurethane material is to be fed. The manner of suspension of the frame member is immaterial; however, in FIGS. 8 and 9 it may be seen that a simple cross bar member 75 is positioned across the top of the mold 71 and mold housing 70 and supports the frame member by extending through the loop 76 of the frame member. The cross bar member is provided with a suitable hole or opening 77 to admit the hook 79 at the opposite end of the frame member. With the frame member thus suspended in the volume of the mold, uncured polyurethane material of appropriate viscosity can then be placed in the mold and be permitted to harden. Once hardened, the finished belt buckle can simply be removed and will contain a decorative face that is a three-dimensional replica of the mold.

The simplicity and the easily practiced methods available for the reproduction of belt buckles constructed in accordance with the teachings of the present invention permit very inexpensive belt buckles to be produced without the requirement that extraordinarily large numbers of belt buckles be produced. For example, once a "master" is available, belt buckles can be produced to reproduce the pictorial view of the master in very small quantities while maintaining the economies heretofore available only when belt buckles are to be produced in the tens of thousands. Of course, if a particular belt buckle design is commercially successful, it may be advisable to proceed with the manufacture of the belt buckle using injection mold techniques and multiple mold processes to mass produce the belt buckle to meet demands. While the specific embodiments chosen for illustration show the use of a three-dimensional design in the buckle face, it will be apparent to those skilled in the art that two dimensional designs may be used. For example, a logo could be printed on the buckle face without a three dimensional representation. Other types of plastics may be utilized in such mass production of the belt buckles of the present invention such as polyethylene frequently used in injection mold procedures. However, in instances where the cost of production would ordinarily militate against the manufacture of a custom buckle, the buckle of the present invention is simple enough that it can be reproduced in very limited quantities without sacrificing the economy achieved through simplicity of the required manufacturing process.

It will also be apparent to those skilled in the art that a variety of plastic materials may be utilized including colored or multicolored plastics and including those that simulate metal. While the present invention has been described in terms of a specific embodiment incorporating details to facilitate the understanding of the principles of construction and operation of the invention, such as the particular plastics used or the types of molds used, such references are not intended to limit the scope of the claims appended hereto. It will be apparent to those skilled in the art that many modifications may be made in the above described embodiments without departing from the spirit and scope of the invention.

What is claimed is:

1. A belt buckle comprising:

(a) a rigid frame member having a loop formed at one end thereof to receive a belt, a hook for insertion into holes provided therefor in a belt, and an intermediate portion rigidly and permanently connecting said loop and said hook;

(b) a solidified plastic material encasing said frame member with said loop and said hook exposed to permit the attachment of said belt to said loop and permit said hook to be inserted in holes provided in said belt;

(c) said solidified plastic material including an outer face for receiving a decorative pattern; and (d) said hook and said loop extending from and exposed on a face of said solidified plastic material opposite to said outer face.

2. The combination set forth in claim 1 wherein said rigid frame member is formed of a metal wire having one end formed into a hook and an opposite end formed into a loop with a straight portion therebetween connecting said loop and hook.

3. The combination set forth in claim 1 wherein said rigid frame member is formed of a metal wire having one end formed into a hook and an opposite end formed in to a loop with a straight portion therebetween connecting said loop and hook.

4. The combination set forth in claim 1 wherein said rigid frame member is formed of a metal plate having one end bent with respect to the remainder and with a hole provided in the bent portion to form a loop to receive a belt, and including a hook member formed at an opposite end thereof for extension into a hole provided therefor in a belt.

5. The combination set forth in claim 1 wherein said solidified plastic material is polyurethane.

6. The combination set forth in claim 1 wherein said solidified plastic material is polyethylene.

* * * * *